US008448953B2

(12) United States Patent
Feddersen, Jr.

(10) Patent No.: US 8,448,953 B2
(45) Date of Patent: May 28, 2013

(54) COWBOY SKATE BOOT AND COVER

(76) Inventor: John Wayne Feddersen, Jr., Kopperl, TX (US)

( * ) Notice: Subject to any disclaimer, the term of this patent is extended or adjusted under 35 U.S.C. 154(b) by 0 days.

(21) Appl. No.: 13/301,091

(22) Filed: Nov. 21, 2011

(65) Prior Publication Data

US 2012/0153582 A1 Jun. 21, 2012

Related U.S. Application Data

(60) Provisional application No. 61/423,845, filed on Dec. 16, 2010.

(51) Int. Cl.
*A63C 17/14* (2006.01)

(52) U.S. Cl.
USPC ..... 280/11.204; 280/11.19; 280/11.221; 280/11.207; 280/11.208; 280/11.36; 280/841; 36/88; 36/89; 36/115; 36/131; 36/136

(58) Field of Classification Search
USPC ..... 280/11.19, 11.204, 11.207, 11.208, 280/11.36, 841, 11.12; 36/89, 131, 136
See application file for complete search history.

(56) References Cited

U.S. PATENT DOCUMENTS

| | | | | | |
|---|---|---|---|---|---|
| 30,278 | A * | 10/1860 | Graham | 280/11.12 |
| 76,353 | A * | 4/1868 | Sherer | 602/27 |
| 703,828 | A * | 7/1902 | Read | 602/27 |
| 863,675 | A * | 8/1907 | Towle | 280/11.19 |
| 1,882,059 | A * | 10/1932 | Boos | 54/83.2 |
| 2,240,532 | A * | 5/1941 | Warner | 280/11.36 |
| 2,546,622 | A * | 3/1951 | Abel | 280/816 |
| 3,756,614 | A * | 9/1973 | Grubin | 280/11.231 |
| 4,061,348 | A | 12/1977 | Carter | |
| 4,534,123 | A * | 8/1985 | Salomon et al. | 36/99 |
| 4,638,794 | A * | 1/1987 | Grisar | 602/27 |
| 5,014,691 | A * | 5/1991 | Cueman et al. | 602/27 |
| 5,692,319 | A * | 12/1997 | Parker et al. | 36/50.1 |
| 5,704,138 | A * | 1/1998 | Donnadieu | 36/58.5 |
| 5,779,246 | A * | 7/1998 | Bengtsson | 280/11.12 |
| 5,956,867 | A | 9/1999 | Harton | |
| 6,042,124 | A * | 3/2000 | Cheatham et al. | 280/11.223 |
| 6,378,230 | B1 * | 4/2002 | Rotem et al. | 36/50.1 |
| 6,442,875 | B1 * | 9/2002 | Joubert et al. | 36/115 |
| 6,679,505 | B2 * | 1/2004 | Yang | 280/11.19 |

(Continued)

OTHER PUBLICATIONS

"Rodeo Rollerskates" [online]. Image, Dec. 26, 2008 [retrieved Nov. 29, 2012]. Retrieved from Internet: <URL: foundshit.com/cowboy-boots-roller-skates/>.*

*Primary Examiner* — J. Allen Shriver, II
*Assistant Examiner* — Steve Clemmons
(74) *Attorney, Agent, or Firm* — Daniel Boudwin

(57) ABSTRACT

Disclosed is an aesthetic and functional skating boot for roller skates, ice skates or inline skates having a lace-less cowboy boot outward appearance. From the exterior, the skate boot resembles a slip-on cowboy boot, comprising a continuous vamp region connecting to a quarter region that provides stability for the user's ankles or alternatively shrouds an internal lacing structure. A skate wheel or blade frame is affixed to the boot outsole and heel lift, connecting to at least two regions of the boot for support of the frame. Interior ankle support within the boot quarter comprises either increased ankle padding or alternatively an internal tongue and lacing structure, similar to a standard pair of laceable skates. Further disclosed is a rear brake or wheelie bar mounted to the boot in the style of a boot spur. The boot provides a fashionable exterior with adequate ankle support, preserving their functional performance.

7 Claims, 3 Drawing Sheets

U.S. PATENT DOCUMENTS

| | | | | |
|---|---|---|---|---|
| 7,552,576 | B2 * | 6/2009 | Strauss | 54/83.1 |
| 2003/0057665 | A1 * | 3/2003 | Matney | 280/11.231 |
| 2004/0019309 | A1 * | 1/2004 | Nelson et al. | 602/65 |
| 2006/0179685 | A1 * | 8/2006 | Borel et al. | 36/50.1 |
| 2009/0019734 | A1 * | 1/2009 | Reagan et al. | 36/115 |
| 2009/0151038 | A1 * | 6/2009 | Muench | 2/23 |

* cited by examiner

COWBOY SKATE BOOT AND COVER

CROSS REFERENCE TO RELATED APPLICATION

This application claims the benefit of U.S. Provisional application No. 61/423,845 filed on Dec. 16, 2010, entitled "Cowboy Skates."

BACKGROUND OF THE INVENTION

1. Field of the Invention

The present invention relates to skate boots and supports. More specifically, the present invention pertains to an aesthetic skate boot or skate boot cover that provides the outward appearance of a cowboy boot. The boot comprises a vamp region that covers the user's foot and a quarter region providing necessary ankle support for the user while skating. The quarter may be provided in a slip-on configuration, wherein embedded ankles support is provided therein, or alternatively the quarter may be utilized as a shroud for an internal ankle support structure having a lace and tongue structure similar to a standard pair of skates. In either embodiment, the external appearance of the device is that of a cowboy boot skate device, wherein no lacing structure is visualized.

Attachable to the quarter region may further be a spur-strap device that wraps around the circumference of the user's ankle region for added support, while providing connection to an extended article. The article may be provided as an extra wheel, a brake or a fashion accessory. The strap is designed to appear similar in style to cowboy boot spur, wherein a tool extends from the rear of the boot heel and attaches using a strap around the quarter of the boot. For skating applications, the strap provides increased ankle support, while the extension may provide a stopping tool or extra wheel for the user to lean back onto while skating, in a configuration that provides a 'wheelie bar.'

2. Description of the Prior Art

Roller skates, ice skates and inline skates share similar structures that facilitate their unique means of transportation or sport. Nearly all skates provide a boot structure connected to a frame that supports either a plurality of wheels or a blade for carving a surface of ice. The boot provides a user with the necessary upper ankle support while wearing the skate and performing a skating motion, which is essential to allow proper action of the blade or wheels and for preventing ankle sprains and injury. The frame of the skate attaches to the sole of the boot structure, attaching continuously therealong or to finite locations to provide a secure attachment between the boot and frame. With exceptions for attachable skate structures that affix to a user's standard shoes, the attached boot and frame structure is a universal combination that is adapted for many different style skates and end user applications.

The type of boot, however, differs drastically between different types of skates, applications thereof, user skill level and the age of the user. For young skaters and roller blade skates, it is common to find a boot having a plurality of slide buckles for closure means. The boot may be segmented and articulate about an ankle joint, or alternatively be of continuous construction. These buckles form a popular closure means, as they allow the boot to be easily taken on or off, provide a simple means of adjusting the boot compression on a user's foot and require little skill to manipulate. A common alternative to the buckle closure means comprises a more standard lace system. Similar to that found on a standard piece of footwear, this closure means includes a lace and tongue structure for closure, and is commonly found on ice skates, hockey roller blades and standard roller skates. The boot structure associated with this lace closure generally comprises a padded leather or composite boot that facilitates foot and upper ankle support. These different types of boots and closure means are well known in the art.

While the structure and style of many skate types are well developed, they are largely designed to provide specific functionality or enhance performance for users, as opposed to any aesthetic or fashionable exterior appearance. The present invention addresses a need in the art for a new skate boot having an exterior appearance similar to a cowboy boot, with an interior structure suited for use as a traditional skate boot. The exterior provides a vamp region devoid of exterior laces or closure means. The vamp is connected to an upstanding quarter region that extends upwardly from the user's ankles. The skate frame connects to the outsole and heel lift of the boot to provide securement of inline wheels, standard roller skates or a blade for carving a surface of ice. The boot quarter interior may further comprise ankle support padding, allowing a slip-on configuration while still providing an adequate level of ankle support while the skates are in use. Alternatively, the quarter may provide an exterior shroud for an internal tongue and lace structure for securely tightening the boot to the user's foot. This embodiment improves the safety and functionality of the skates, as the secure fitment provides the necessary ankle support for more aggressive maneuvers.

Devices have been disclosed and patented for skate boots and skate boot shrouds; however these devices fail to contemplate a cowboy-style, fashionable boot exterior. U.S. Pat. No. 5,956,867 to Harton describes a contoured cover including a lateral and medial panels constructed of a thermally insulative, stretchable material. The panels form a unitary body having an ankle opening, a blade opening and a pair of conforming front flaps. Flap fasteners allows the cover to stretch and connect over the exterior of a skate boot for thermal insulation purposes in colder climates or skating conditions. While this device provides a shroud and cover for an underlying skate, it is not contemplated for providing the exterior appearance or features of a cowboy boot. Rather, its purpose is for retaining heat within the user's feet and providing an external layer of insulation thereto, without interfering with a skate's functionality.

U.S. Pat. No. 4,061,348 to Carter describes a skate attachment to a standard piece of footwear. A pair of foot-sized plates having a hinged heal portion and a forward foot securing means, along with a strap that attaches around a user's footwear, provides a means of attachment. Below the plates are roller wheels, which allow the user's shoes to be transformed into roller skates. While the Carter device provides a means to utilize a common pair of shoes or boots for skating purposes, the structure and intent of this invention differ drastically from the present invention. The present invention provides a unique skate boot, wherein a cowboy boot is provided from the exterior and the interior houses an ankle support means for unaltered utility of the underlying skating apparatus.

While examples of cowboy boot skates seem similar to the disclosed invention, wherein a standard pair of cowboy boots have been fitted to a skate frame for aesthetic uses, the actual function of the present invention is to provide an exterior appearance of a cowboy boot, combined with the functionality and performance provided by a standard pair of skates. Any cowboy boot skates currently available are merely novelty items that provide little ankle support or usability while skating. The lack of support reduces the performances of the skates to mere appearance, having very little practical ability to skate without risking ankle sprains or similar injury. Foot and ankle support are key components to successful skating, and cannot be overlooked when designing any type of skate apparatus. The present invention utilizes internal support and an aesthetic, novelty exterior only. It substantially diverges in design elements from the prior art and consequently it is clear that there is a need in the art for an improvement to existing novelty cowboy boot skating devices. In this regard the instant invention substantially fulfills these needs.

SUMMARY OF THE INVENTION

In view of the foregoing disadvantages inherent in the known types of skate boot devices now present in the prior art, the present invention provides a new skate boot wherein the same can be utilized for providing convenience for the user wherein the skate exterior resembles a cowboy boot, while the device interior provides necessary ankle support for unaltered performance or safety for the user.

It is therefore an object of the present invention to provide a new and improved skate boot device that has all of the advantages of the prior art and none of the disadvantages.

Another object of the present invention to provide a skate boot having an outward appearance of a cowboy boot with improved ankle support means.

Another object of the present invention is to provide a skate boot ankle support means comprising an internal tongue and lacing structure.

Yet another object of the present invention is to provide a skate boot ankle support means comprising a largely rigid ankle support padding region within the cowboy boot quarter.

Still yet another object of the present invention is to provide a skate boot ankle support means comprising a spur strap wrapping around the outer circumference of the boot quarter.

A final object of the present invention is to disclose embodiments of a spur strap extension, wherein a rear wheel or a rear brake are provided that extend outwardly from the boot heel and from the spur strap wrapped around the boot quarter region.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
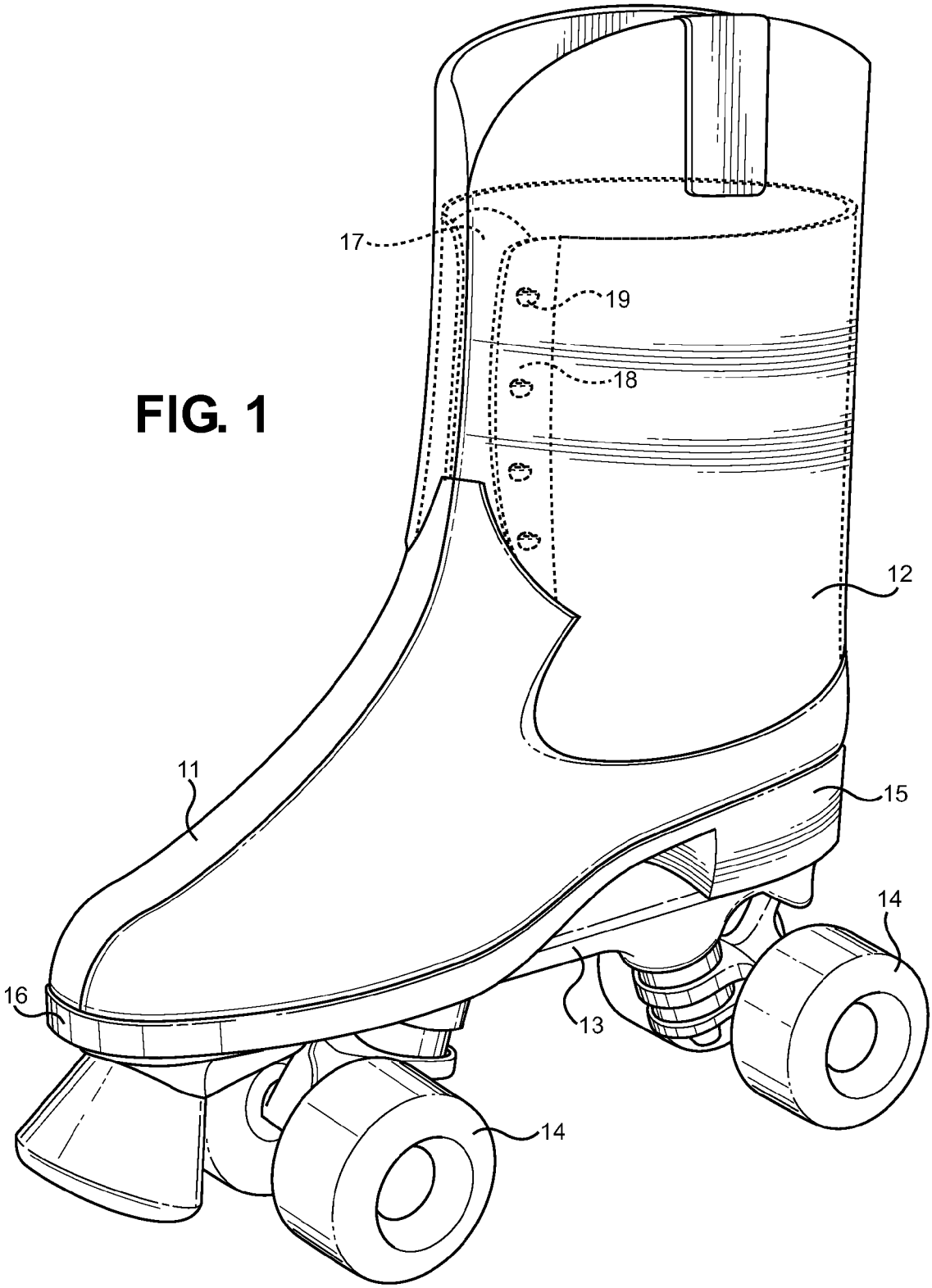
FIG. 1 shows a perspective view of the present invention and underlying ankle support means.

Reference is made herein to the attached drawings. Like reference numerals are used throughout the drawings to depict like or similar elements of the cowboy skate boot. For the purposes of presenting a brief and clear description of the present invention, the preferred embodiment will be discussed as used for supporting a user's ankle while providing an outward cowboy boot appearance. The figures are intended for representative purposes only and should not be considered to be limiting in any respect.

Referring now to FIG. 1, there is shown a perspective view of a particular embodiment of the present invention, wherein a cowboy skate is provided with an internal ankle support means comprising an internal tongue and lacing structure and in connection to a standard skate frame 13 having two pairs of aligned wheels 14. The skate boot employs a segmented construction with an outward appearance of that of a slip-on, cowboy boot style having an outsole 16, a vamp region 11 and an upper quarter region 12. The vamp 11 and quarter 12 combine to form the foot covering and ankle region, while the outsole 16 provides a stable sole structure having a forward region and a rear heel lift 15 portion at the rear of the boot. The boot is designed as an outwardly aesthetic or novelty appearance, while its ankle region is provided in an open, slip-on configuration, a slip-on configuration with internal padding, or in a configuration having a laceable upper 18 with eyelets or grommets 19 for securely tightening the upper 18 using threaded laces. In this way, the ankle of the user is provided support while skating, while the outward appearance is not changed from a continuous quarter 12 having a lace-less appearance.

The overall structure of the skate device comprises the cowboy boot upper having either an open ankle region or imbedded support therein, while a skate frame 13 attaches along the boot outsole 16 and to the heel lift 15 portion along the heel of the boot. The heel lift 15 is a raised area of the outsole, wherein the user's heel is positioned on a platform and elevated above his or her toe region. The skate frame 13 may take several forms, as it is not desired to limit this structure to a particular style of skate. It is alternatively contemplated that the skate frame 13 supports a skating means that may comprise a standard set of roller skates having a pair of aligned wheels 14, an inline skate configuration wherein a plurality of aligned wheels are provided from heel to toe, or finally an ice skating blade frame may be provided to offer support for a figure skating or hockey skating blade. The final embodiment provides support for a blade that is adapted to carve a surface of ice, while the previous roller wheel embodiments are adapted for use on dry, indoor or outdoor surfaces.

Figure 2:
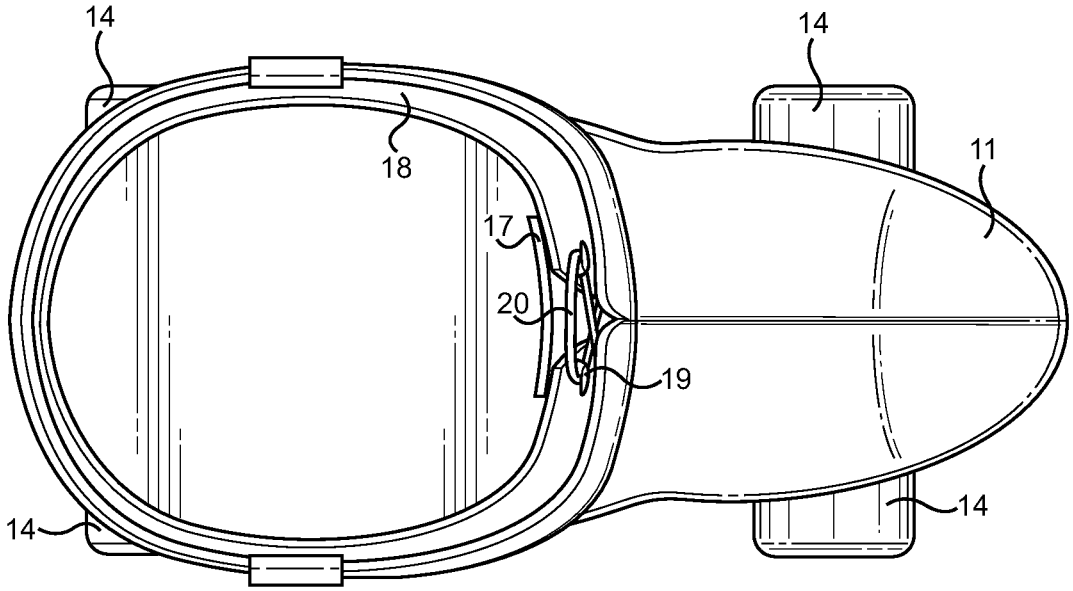
FIG. 2 shows an overhead view of the first embodiment of the present invention.
Figure 3:
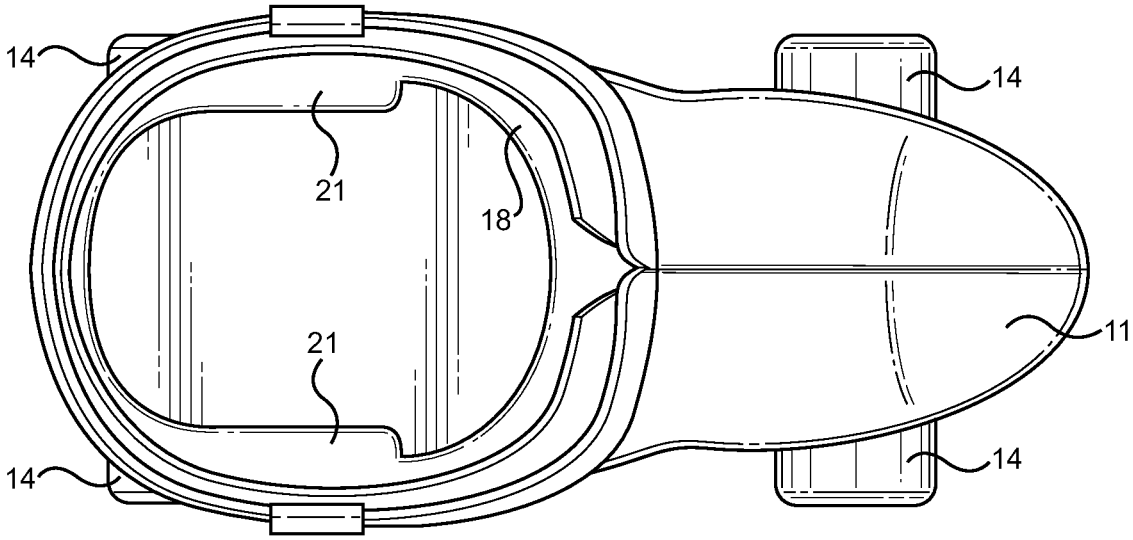
FIG. 3 shows an overhead view of the second embodiment of the present invention.

Referring now to FIG. 2, there is shown an overhead view of the laceable embodiment of the present invention. Internal ankle support means in the form of a tongue 17 and lace 20 structure is visualized within the quarter of the boot. An internal ankle support 18 is provided for the tongue and lace structure to tighten around the user's ankle without changing the outward appearance of the cowboy boot quarter. The laces 20 are fed through eyelets or grommets 19 along the opening of the support 18 and cinched tight to support the ankle and prevent unwanted rotation or bending while performing skate activities. This embodiment is an alternative form of the base invention, wherein a slip-on quarter is provided. Any embodiment of the ankle region connects to a continuous vamp 11 and an embodiment of the skate frame. In FIGS. 2 and 3, the skate frame embodiment is shown supporting a standard roller skate configuration having two pairs of side-by-side wheels 14.

Referring now to FIG. 3, there is shown an overhead view of an embodiment of the present invention wherein the skate boot is provided with a slip-on quarter region. In this configuration, the internal structure of the quarter may employ a level of imbedded ankle means comprising support padding 21 that attaches to a thickened region 18 along the interior circumference of the boot quarter. The slip-on configuration may further be provided with no additional ankle support, wherein the boot quarter does not firmly secure to the user's upper ankle or lower leg region for support. In the supported embodiment, however, ankle padding 21 is provided to envelope and provide lateral stability to the ankle joint during skating movements, preventing ankle rolling or twisting. The padding may comprise thickened padding that conforms to the user's ankle geometry after several uses, as is found in most hockey skate ankle regions. It is not, however, desired to limit the slip-on configuration to having ankle support or a particular type thereof. It is desired to disclose embodiments of a cowboy boot novelty skate with imbedded features that expand its utility and functionality as a skating device with outward aesthetic qualities.

Figure 5:
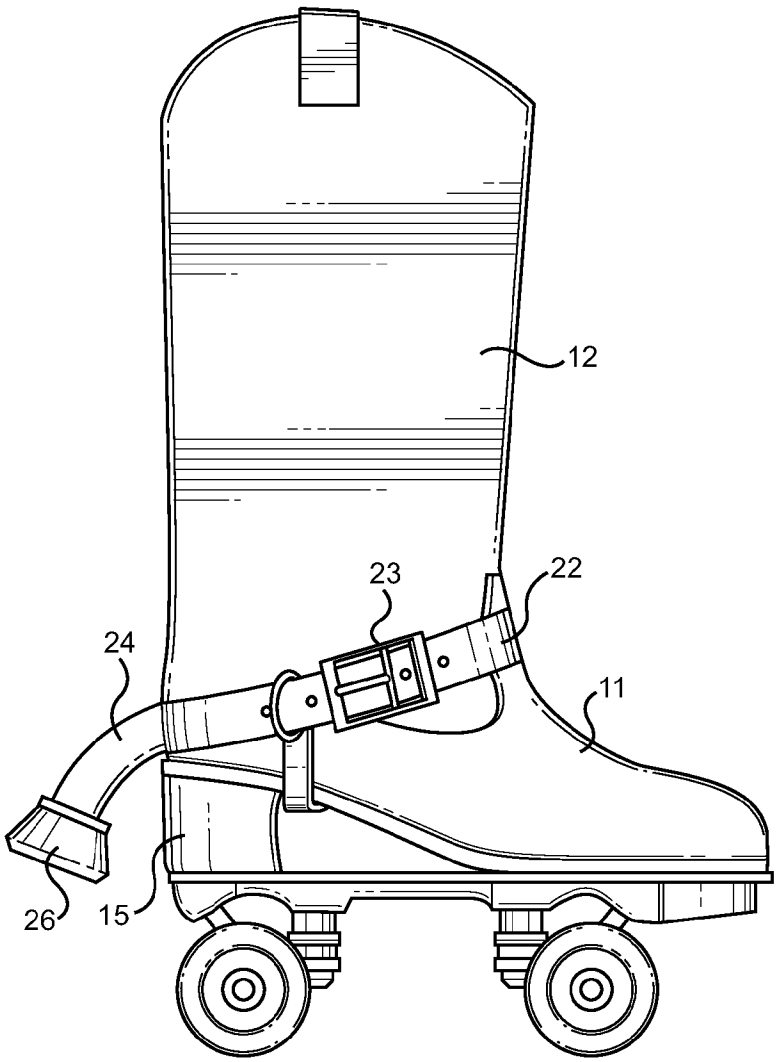
FIG. 5 shows a side view of the present invention wherein a particular embodiment of the spur strap is provided, taking the form of a rear brake.
Figure 4:
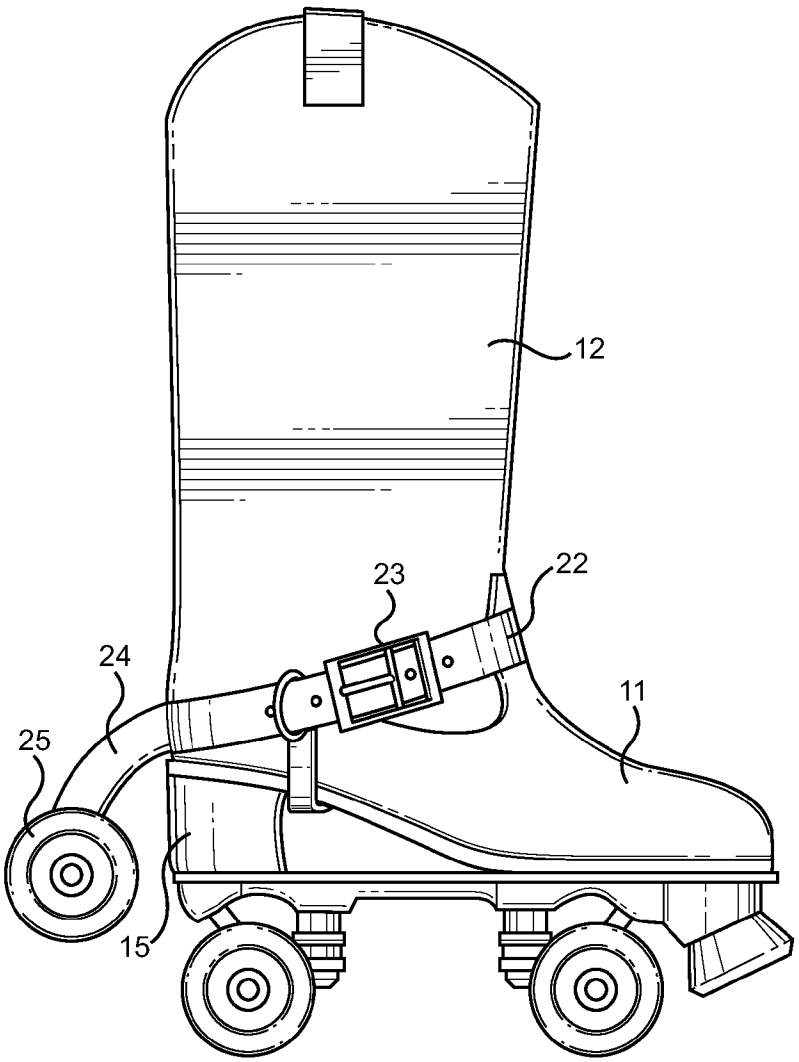
FIG. 4 shows a side view of the present invention wherein a particular embodiment of the spur strap is provided, taking the form of an extra wheel.

Referring now to FIG. 4 and FIG. 5, there are shown sides views of the skate boot of the present invention with two embodiments of a spur-strap ankle support attachment and extended article. The spur-strap 22 provides an ankles support that wraps around the exterior of the boot at the boundary of the quarter 12 and vamp 11 region. The strap 22 is cinched into position via a buckle 23 or similar tensioner means, providing lateral stability to the user while skating in any embodiment of the boot. A stirrup attachment runs from the strap 22 and underneath the boot just in front of the heel lift 15 and connecting to an opposite side of the strap. The stirrup ensures the strap stays in place during use, and does not migrate from its ideal location at the base of the ankle. At the base of the quarter 12, the strap attaches to an extension member 24 above the heel lift 15 of the boot. The extension 24 provides the user with an accessory that is similar in style to a cowboy boot spur; however, the extended article may take the form of an additional wheel 25 or a stopper brake 26 for slowing the skate by depression against the ground surface. In either embodiment, the user may engage the article by leaning the skate backwards, placing either the wheel 25 or brake 26 against the ground. The extra wheel 25 allows the user to lean back in the form of a 'wheelie-bar' for stunts or skating maneuvers.

Overall, the present invention provides a user with a novelty skating device with imbedded feature that allow normal skating operation with varying levels of ankle support. The outward appearance is that of a cowboy boot having a continuous vamp and quarter region and a lace-less configuration. The internal structure provides ankle support in the way of ankle padding, a tongue and lace structure or an outward strap that connects to a rearward article and appears similar to a cowboy spur. The skate boot is provided to function with any type of typical skate frame, including roller skates, inline skates and different styles of ice skates. In this way, the user may adorn the cowboy boot for aesthetic reasons, while skating as normally conducted with little risk of injury and the same level of performance.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A skate boot having an outward appearance of a lace-less cowboy boot, comprising:

a skate boot having a vamp region, a quarter region, an outsole and a heel lift;

a skate frame attaching to said boot outsole and heel lift;

said skate frame providing support for a skating means;

an outwardly extending extension member resembling a cowboy spur, a stopper brake attached to said extension member distal end.

2. The device of claim 1, wherein said skate boot quarter region further comprises internal ankle support in the form of a thickened padding region having ankle padding to prevent rolling of said ankle.

3. The device of claim 1, wherein said skate boot quarter region further comprises internal ankle support in the form of a tongue and lace structure attaching to an internal ankle support, wherein said laces are fed through eyelets and cinched tight to secure said internal ankle support around said user ankle.

4. The device of claim 1, further comprising an external ankle strap extending around said quarter region, said strap having a tensioner means for securing fitting said strap along with a stirrup strap that runs beneath the boot to secure the strap location to provide ankle support thereto.

5. The device of claim 1, wherein said skate frame supports a pair of aligned roller skate wheels.

6. The device of claim 1, wherein said skate frame supports a plurality of inline roller wheels.

7. The device of claim 1, wherein said skate frame supports ice skate blade.

* * * * *